US005110703A

United States Patent [19]

Nagatsuka et al.

[11] Patent Number: 5,110,703

[45] Date of Patent: May 5, 1992

[54] CARRIER FOR DEVELOPER

[75] Inventors: Ikutaroh Nagatsuka; Chiaki Suzuki; Masayuki Takeda; Yasuo Matsumura; Takayoshi Aoki, all of Kanagawa, Japan

[73] Assignee: Fuji Xerox Co., Ltd., Tokyo, Japan

[21] Appl. No.: 496,138

[22] Filed: Mar. 19, 1990

Related U.S. Application Data

[63] Continuation of Ser. No. 148,345, Jan. 25, 1988, abandoned.

[30] Foreign Application Priority Data

Jan. 26, 1987 [JP] Japan ..... 62-014078
Jan. 26, 1987 [JP] Japan ..... 62-014079
Jan. 26, 1987 [JP] Japan ..... 62-014080

[51] Int. Cl.[5] ..... G03G 9/10
[52] U.S. Cl. ..... 430/108; 430/106.6
[58] Field of Search ..... 430/137, 114, 108

[56] References Cited

U.S. PATENT DOCUMENTS 4,486,559 12/1984 Murata et al. ..... 430/137
4,557,991 12/1985 Takagiwa et al. ..... 430/114
4,764,445 8/1988 Miskinis et al. ..... 430/108

*Primary Examiner*—John Goodrow
*Attorney, Agent, or Firm*—Finnegan, Henderson, Farabow, Garrett and Dunner

[57] ABSTRACT

A carrier for use in developing an electrostatic or magnetic latent image in electrophotography, electrostatic recording, electrostatic printing or the like, which carrier is produced by atomizing a molten mixture of a magnetic powder and a binder resin containing a polyolefin and a polyolefin having a functional group. The polyolefin having a functional group is present in an amount ranging from about 50% by weight or less based on the total weight of the binder resin.

14 Claims, No Drawings

CARRIER FOR DEVELOPER

This application is a continuation of application Ser. No. 07/148,345, filed Jan. 25, 1988 now abandoned.

FIELD OF THE INVENTION

This invention relates to a carrier for a two-component type developer, and more particularly a magnetic substance-dispersed carrier, which is used for developing an electrostatic or magnetic latent image in electrophotography, electrostatic recording, electrostatic printing, and the like.

BACKGROUND OF THE INVENTION

In general electrophotography, an electrostatic latent image is formed through various means on a photoreceptor which comprises a photoconductive substance, such as selenium, and a toner is deposited on the latent image by magnetic brush development or a similar technique to thereby make the latent image visible.

In the process of development, a carrier is used to impose an appropriate positive or negative charge on the toner particles. Various types of carriers have been developed and put to practical use.

Among various performance characteristics required for the carrier, particularly important are appropriate electrostatic charging properties, impact resistance, abra-sion resistance, developing properties and working life. Taking these characteristic requirements into consideration, conventional carriers still leave room for improvement, and none of them is quite satisfactory. For example, although conductive carriers, such as iron oxide particles, are superior in solid developability, they are inferior in reproducibility of fine lines and, in addition, require the presence of a special charge controlling agent for obtaining a prolonged working life of developer. On the other hand, coated insulating carriers are excellent in working life and fine line reproducibility but poor in solid reproducibility.

In an attempt to overcome these disadvantages, small-sized carriers comprising a binder resin having magnetic fine powders dispersed therein, i.e., so-called microtoning carriers, have been proposed and put into practical use. However, a carrier of this type undergoes adhesion to a photoreceptor because of its small particle size. Adhesion to a photoreceptor might be prevented by increasing the particle size of the carrier but, in turn, an increased size brings about reduction of charging properties, which leads to fog, or contamination of the interior of a developing machine. Moreover, magnetic particles released out of the surface of the carrier cause variation in the quantity of electric charge according to changes in humidity, and also drastic prolongation of life cannot be achieved due to difficulty in carrier surface treatment.

SUMMARY OF THE INVENTION

Accordingly, one object of this invention is to provide a novel carrier for magnetic brush development for use in development of an electrostatic latent image in electrophotography, electrostatic recording, and the like.

Another object of this invention is to provide a carrier for magnetic brush development which causes no reduction of charge quantity, thereby reducing fog or contamination of the developing machine in the initial stage.

Another object of the invention is to provide a developer having a prolonged life and rapid developability.

It has now been found that the above objects of this invention can be accomplished by utilizing a carrier for a developer, which is obtained by atomizing a molten mixture comprising as main components a magnetic fine powder and a binder resin containing a polyolefin and not more than about 50% by weight based on the total weight of the binder resin of a polyolefin having a functional group and then solidifying the atomized particles by cooling.

DETAILED DESCRIPTION OF THE INVENTION

The functional group to be introduced into the polyolefin may include an oxygen-containing functional group, e.g., a hydroxyl, a carboxyl, an ester, a carbonyl, an ether, etc.; a nitrogen-containing functional group, e.g., an amino, an amido, an imido, a nitrile, etc.; a halogen-containing functional group, e.g., chlorine, fluorine, a perfluoroalkyl, etc.; an aromatic group, e.g., a phenyl, a naphthyl, etc.; a silicon-containing functional group, e.g., a trimethylsilane, a trimethylsiloxane, a oligodimethylsiloxane, etc.; and the like. Among these, the preferred functional groups are a carboxyl, hydroxyl, an amino, a phenyl, and fluorine. These functional groups may be introduced either individually or in combinations of two or more thereof.

The number of the functional group in the polyolefin is generally from 0.05 to 0.5, preferably not more than 0.2, per one monomer unit (olefin monomer) constituting the polyolefin.

Introduction of the above-recited functional groups into polyolefin can be carried out by an appropriate method selected depending on the type of functional group introduced. Examples of the available methods include direct chemical reaction of polyolefin, such as oxidation, reduction, halogenation, etc.; copolymerization of an olefin monomer and a functional group-containing monomer; polymerization of a functional group-containing monomer in the presence of polyolefin; and polymerization of an olefin monomer in the presence of a functional group-containing polymer.

The olefin monomer which can be used in the present invention includes ethylene, propylene, butylene, isobutylene, etc., and the polyolefin to be used includes polymers of these olefin monomers as well as polymers of conjugated diene type aliphatic diolefin monomers, e.g., 1,3-butadiene, 1,3-pentadiene, 2,3-dimethyl-1,3-butadiene, 2,4-hexadiene, 3-methyl-2,4-hexadiene, etc.

Examples of the functional group-containing monomer include styrene monomers, such as styrene, alkylstyrenes (e.g., methylstyrene, dimethylstyrene, trimethylstyrene, ethylstyrene, diethylstyrene, triethylstyrene, propylstyrene, butylstyrene, hexylstyrene, heptylstyrene, octylstyrene, etc.), halogenated styrenes (e.g., fluorostyrene, chlorostyrene, bromostyrene, dibromostyrene, iodostyrene, etc.), nitrostyrene, acetylstyrene, methoxystyrene, etc.; addition polymerizable unsaturated aliphatic monocarboxylic acids, e.g., acrylic acid, methacrylic acid, α-ethylacrylic acid, crotonic acid, α-methylcrotonic acid, α-ethylcrotonic acid, isocrotonic aid, angelic acid, etc.; addition polymerizable unsaturated aliphatic dicarboxylic acids, e.g., maleic acid, fumaric acid, itaconic acid, citraconic acid, mesaconic acid, glutaconic acid, dihydromuconic acid, etc.; esters of the above-enumerated addition polymerizable unsaturated mono- or dicarboxylic acids with alcohols, such as alkyl alcohols (e.g., methyl alcohol, ethyl alcohol, propyl alcohol, butyl alcohol, amyl alcohol, hexyl alcohol, heptyl alcohol, octyl alcohol, nonyl alcohol, dodecyl alcohol, tetradecyl alcohol, hexadecyl alcohol, etc.), alkoxyalkyl alcohols that are partially alkoxylated alkyl alcohols (e.g., methoxyethyl alcohol, ethoxyethyl alcohol, ethoxymethyl alcohol, methoxypropyl alcohol, ethoxypropyl alcohol, etc.), aralkyl alcohols (e.g., benzyl alcohol, phenylethyl alcohol, phenylpropyl alcohol, etc.), alkenyl alcohols (e.g., allyl alcohol, crotonyl alcohol, etc.), and the like; amides and nitriles derived from the above-described addition polymerizable unsaturated mono- or dicarboxylic acids: halogenated aliphatic olefins, e.g., vinyl chloride, vinyl bromide, vinyl iodide, 1,2-dichloroethylene, 1,2-dibromoethylene, 1,2-diiodoethylene, isopropenyl chloride, isopropenyl bromide, allyl chloride, allyl bromide, vinylidene chloride, vinyl fluoride, vinylidene fluoride, etc.; and nitrogen-containing vinyl monomers, e.g., 2-vinylpyridine, 4-vinylpyridine, 2-vinyl-6-methylpyridine, 2-vinyl-5-methylpyridine, 4-butenylpyridine, 4-pentylpyridine, N-vinylpiperidine, 4-vinylpiperidine, N-vinyldihydropyridine, N-vinylpyrrole, 2-vinylpyrrole, N-vinylpyrroline, N-vinylpyrrolidine, 2-vinylpyrrolidine, N-vinyl-2-pyrrolidone, N-vinyl-2-piperid-one, N-vinylcarbazole, etc. and the like. Of the aboverecited esters of addition polymerizable unsaturated carboxylic acids, particularly preferred are alkyl acrylates, alkyl methacrylates, alkyl fumarates, and alkyl maleates. These monomers may be used either individually or in combinations of two or more thereof.

In the present invention, the most preferred polyolefin having a functional group in a fluorine-containing polymer obtained by polymerizing a fluorine-containing monomer in the presence of polyolefin. For example, the fluorine-containing monomer and a radical polymerization initiator are added in a solution or dispersion containing the polyolefin in a solvent, e.g., toluene, xylene, etc. and the monomer is polymerized. The fluorine-containing monomer includes general radical-polymerizable fluorine-containing compounds, and it may be used in combination with the other functional group-containing monomers.

Specific examples of the fluorine-containing monomers include monomers carrying a fluorine atom in the main chain thereof, e.g., tetrafluoroethylene, trifluoroethylene, vinlylidene fluoride, monofluoroethylene, hexafluoropropylene, etc.

Compounds having a fluorine atom in the side chain thereof can also be advantageously employed. Typical examples of such compounds are fluorinated alkyl acrylates and fluorinated alkyl methacrylates. Specific examples of these compounds are esters of acrylic acid or methacrylic acid with 1,1-dihydroperfluoroethyl, 1,1-dihydroperfluoropropyl, 1,1-dihydroperfluorohexyl, 1,1-dihydroperfluorooctyl, 1,1-dihydroperfluorodecyl, 1,1-dihydroperfluorolauryl, 1,1,2,2-tetrahydroperfluorobutyl, 1,1,2,2-tetrahydroperfluorohexyl, 1,1,2,2-tetrahydroperfluorooctyl, 1,1,2,2-tetrahydroperfluorodecyl, 1,1,2,2-tetrahydroperfluorolauryl, 1,1,2,2-tetrahydroperfluorostearyl, 2,2,3,3-tetrafluoropropyl, 2,2,3,3,4,4-hexafluorobutyl, 1,1,ω-trihydroperfluorohexyl, 1,1,ω-trihydroperfluorooctyl, 1,1,1,3,3,3-hexafluoro-2-chloropropyl, 3-perfluorononyl-2-acetylpropyl, 3-perfluorolauryl-2-acetylpropyl, N-perfluorohexylsulfonyl-N-methylaminoethyl, N-perfluorohexylsulfonyl-N-butylaminoethyl, N-perfluorooctylsulfonyl-N-methylaminoethyl, N-perfluorooctylsulfonyl-N-butylaminoethyl, N-perfluorodecylsulfonyl-N-methylaminoethyl, N-perfluorodecylsulfonyl-N-ethylaminoethyl, N-perfluorodecylsulfonyl-N-butylaminoethyl, N-perfluorolaurylsulfonyl-N-methylaminoethyl, N-perfluorolaurylsulfonyl-N-ethylaminoethyl, N-perfluorolaurylsulfonyl-N-butylaminoethyl, etc.

Examples of polyolefin which can be used in combination with the functional group-containing polyolefin include polymers of the olefin monomers and/or the conjugated diene type aliphatic diolefin monomers as described above.

The functional group-containing polyolefin according to the present invention is preferably used in an amount ranging from 0.01 to 50% by weight, more preferably from 0.2 to 30% by weight, based on the total weight of the binder resin. When a fluorine-containing polyolefin obtained by polymerizing a fluorine-containing monomer in the presence of polyolefin is used, it is preferably present in an amount ranging from 0.01 to 20% by weight, more preferably from 0.2 to 10% by weight, based on the total weight of the binder resins. When the amount of the functional group-containing polyolefin is more than 50% by weight, viscosity of the resulting molten mixture increases so that it is difficult to form spherical particles upon atomizing.

The magnetic fine powder to be dispersed in the binder resin containing the functional group-containing polyolefin may be any ferromagnetic powder commonly employed in the art, such as $Fe_3O_4$, $\gamma$-$Fe_2O_3$, various ferrite powders, chromium oxide, various metal fine powders, such as iron powder, and the like. The magnetic fine powder generally has a particle size of from about 0.05 to 10 $\mu$m and preferably from about 0.1 to 5 $\mu$m.

The magnetic fine powder is usually used in an amount ranging from about 30 to 95% by weight, preferably from about 45 to 90% by weight, based on the total amount of the binder resin including the functional group-containing polyolefin.

For the purpose of controlling charge quantity or for improving dispersibility, strength, and powder fluidity or other various purposes, the carrier according to the present invention may further comprise various additives, such as other resins, charge controlling agents, coupling agents, fillers, and other fine powders in addition to the essential components, i.e., the magnetic fine powder, the polyolefin and the functional group-containing polyolefin.

The carrier of the present invention can be produced by melt-mixing the above-described components by initial heating generally at a temperature of from about 100° to 300° C., preferably from 150° to 250° C., followed by cooling the molten mixture with an air stream at a relatively low temperature (about 10° to 100° C., preferably about 20° to 50° C.) to solidify. In more detail, the mixing and cooling can be effected by the use of an apparatus composed of a melt-mixing device and a viscosity-controlling tanks as pretreatment means, a pump for carrying the molten mixture to an atomizer, and a cooling tower for cooling and solidifying the atomized mixture. The melt-mixing device may include a kneader, a roll mill, a Banbury mixer, a sand mill, an attritor, a Henschel mixer, etc. The atomizer which is suitable for obtaining carrier particles having a small size may include a nozzle type and a disc type, but is not limited thereto. The viscosity of the molten mixture just before the atomization preferably ranges from 3 to 100 poise.

In view of maintaining a balance between the working life of a developer, prevention of the carrier from adhesion onto a photoreceptor and image quality, the carrier parti-cles according to the present invention are of a small size, preferably having a mean particle size ranging from about 20 to 400 μm and more preferably from about 30 to 200 μm.

The solidified particles thus produced can be used as such carrier particles. If desired, they may be subjected to surface treatment or coating treatment with resins, coupling agents, surface active agents, charge controlling agents, or other fine powders, taking advantage of the spherical form and high surface smoothness of the carrier particles obtained by atomization followed by cooling.

In a preferred embodiment of the present invention, the solidified carrier particles are subjected to a coating treatment to form a coat layer therearound in order to ensure the above-described performance characteristics as carrier.

Any of the generally employed soluble resins can be used for coating, including mono- or copolymers of styrene compounds, e.g., styrene, chlorostyrene, vinylstyrene, etc.; vinyl esters, e.g., vinyl acetate, vinyl propionate, vinyl benzoate, vinyl butyrate, etc.; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers, e.g., vinyl methyl ether, vinyl ethyl ether, vinyl butyl ether, etc.; and vinyl ketones, e.g., vinyl methyl ketone, vinyl hexyl ketone, vinyl isopropenyl ketone, etc. In particular, typical coating resins include polystyrene, a styrene-alkyl acrylate copolymer, a styrene-alkyl methacrylate copolymer, a styrene-acrylonitrile copolymer, a styrenebutadiene copolymer, and a styrene-maleic anhydride copolymer.

Polyester, polyurethane, epoxy resins, silicone resins, polyamide, modified rosin , paraffin, and waxes can also be used as a coating resin.

Further, halogen-containing polymers may also be used for coating. Examples of such polymers are homopolymers of chlorinated olefins or monomers containing fluorine in the main chain thereof (e.g., tetrafluoroethylene, tri-fluoroethylene, vinylidene fluoride, monofluoroethylene, hexafluoropropylene, etc.) and copolymers of these monomers and other copolymerizable unsaturated bond-containing monomers, e.g., ethylene, propylene, butylene, vinyl chloride, vinylidene chloride, trifluoroethylene, etc. Compounds having a fluorine atom in the side chain thereof are also advantageous as monomers for the coating resins. Typical examples of such monomers are fluorinated alkyl acrylates and fluorinated alkyl methacrylates. In addition, fluorinated epoxy resins, fluorinated polyester resins, fluorinated silicone resins, etc. are also employable.

These coating materials may be used either individually or in combinations of two or more thereof. The coating material is preferably selected so as to have good affinity for the functional group introduced into the polyolefin in order to assure adhesion of the coat layer to prevent the coat layer from falling off.

If desired, the coating resin may contain charge controlling agents, coupling agents, fillers, or other fine powders for the purpose of charge control, improvement of dispersibility, enhancement of strength, improvement of fluidity, and the like.

The coat layer can be formed by a known solvent coating technique, in which the coating resin with or without additives are dissolved or dispersed into a solvent that does not dissolve the binder resin for the carrier core, the solution or dispersion is coated on the surface of the carrier core, and the solvent is then removed. Coating apparatus which can be used include a fluidized bed, a spray drier, a kneader coater, and other general coating devices.

The coat layer preferably has a thickness ranging from 0.01 to 5 μm, and more preferably from 0.1 to 1.0 μm.

The thus obtained carrier of the present invention is mixed with a toner to prepare a magnetic brush developer for developing an electrostatic latent image.

The toner to be mixed is not particularly restricted and includes any of electrically chargeable toners for use in general electrophotography, which comprise a binder resin having dispersed therein a colorant.

The carrier in accordance with the present invention, either coated or uncoated, is advantageous in that charging properties can be controlled arbitrarily by selecting the kind and amount of the functional group to be introduced to the polyolefin. When, in particular, a functional group of low surface energy, such as a fluorine-containing group, a silicon-containing group, etc., is introduced into the polyolefin, the surface energy of the resulting carrier particles is decreased to thereby prolong the life.

Further, when using a fluorine-containing polymer obtained by polymerizing a fluorine-containing monomer in the presence of polyolefin, since this polymer has a very low surface energy, it is shifted to the surface of the carrier particles and spontaneously precipitated there upon atomization and cooling. Since a part of the precipitated fluorine-containing polymer is grafted to the polyolefin, there is thus formed a stable fluorine-containing layer on the carrier surface through one step. Accordingly, it is possible to decrease the surface energy of the carrier particles by addition of a small amount of a fluorine-containing polymer to thereby reduce toner impaction onto the carrier, which leads to a prolonged life.

Furthermore, since the carrier particles according to the present invention have a spherical form and a smooth surface, a thin and strong coat layer can be provided thereon more easily as compared to conventional amorphous carrier particles obtained by kneading and grinding. The carrier having a coat layer exhibits ensured environmental stability, particularly freedom from variation of charge quantity due to changes in humidity between summer and winter because the magnetic fine powders are not released out of the surface. It is also possible to control charging properties of the carrier by selecting the kind and amount of the coating resin or additives for the coat layer. In cases of using a coating resin having a low surface energy, such as a fluorinated resin, a silicone resin, etc., the coated carrier is prevented from contamination with a toner to thereby prolong the working life and stabilize charging properties.

The present invention is now illustrated in greater detail with reference to Examples and Comparative Examples, but it should be understood that the present invention is not deemed to be limited thereto. In these Examples, all the parts, percents, and ratios are by weight unless otherwise indicated.

EXAMPLE 1

| | |
|---|---|
| Magnetic fine powder (EPT-1000, produced by Toda Kogyo K.K.) | 80 parts |
| Polyethylene (Mitsui Hiwax 400P, produced by Mitsui Petrochemical Ind., Ltd.) | 10 parts |
| Polyethylene having a carboxyl group (acid value: 20 KOH/mg) | 10 parts |

The above components were melt-kneaded by heating in a pressure kneader. The resulting molten mixture (viscosity 5,000 cps) was atomized and cooled to solidify by means of a disc type atomizer, followed by classification to obtain a spherical magnetic powder-dispersed carrier having a mean particle size of 100 μm.

COMPARATIVE EXAMPLE 1

| | |
|---|---|
| Magnetic fine powder (EPT 1000) | 80 parts |
| Polyethylene (Mitsui Hiwas 400P) | 20 parts |

The above components were kneaded, granulated, and classified in the same manner as in Example 1 to obtain a spherical magnetic powder-dispersed carrier having a mean particle size of 100 μm.

EXAMPLE 2

| | |
|---|---|
| Magnetic fine powder (EPT 1000) | 80 parts |
| Polyethylene (Mitsui Hiwax 400P) | 15 parts |
| Ethylene-styrene copolymer (8:2) | 5 parts |

The above components were melt-kneaded by heating in a pressure kneader. The resulting molten mixture (viscosity 5,000 cps) was atomized and cooled to solidify by means of a disc type atomizer, followed by classification to obtain a spherical magnetic powder dispersed carrier having a mean particle size of 100 μm.

EXAMPLE 3

A hundred parts of the carrier particles obtained in Example 2 were coated with a 10% acetone solution containing 0.5 part of a styrene-methyl methacrylate-acrylic acid copolymer (80:15:5 by mol) by the use of a fluidized bed coating apparatus to obtain a coated carrier.

COMPARATIVE EXAMPLE 2

A hundred parts of the carrier particles obtained in Comparative Example 1 were coated with 0.5 part of a styrene-methyl methacrylate-acrylic acid copolymer (80:15:5 by mol) in the same manner as in Example 3 to obtain a coated carrier.

EXAMPLE 4

| | |
|---|---|
| Magnetic fine powder (EPT-1000) | 80 parts |
| Polyethylene (Mitsui Hiwax 400P) | 19.8 parts |
| 5:5 Copolymer of perfluorohexylethyl methacrylate and polyethylene (Mitsui Hiwax 400P) obtained by polymerizing perfluorohexylethyl methacrylate in the presence of polyethylene | 0.2 part |

The above components were melt-kneaded by heating in a pressure kneader, and the molten mixture (viscosity 7,500 cps) was atomized and cooled to solidify by means of a disc type atomizer, followed by classification to obtain a spherical magnetic powder-dispersed carrier having a mean particle size of 100 μm.

EXAMPLE 5

A hundred parts of the carrier particles obtained in Example 4 were coated with a 10% solution of 0.2 part of a perfluorohexylethyl methacrylate polymer in a fluorine-containing solvent (Diflon Solvent S-3, produced by Daikin Kogyo Co., Ltd.) by means of a kneader coater to obtain a coated carrier.

COMPARATIVE EXAMPLE 3

A hundred parts of the carrier particles obtained in Comparative Example 1 were coated with 0.2 part of a perfluorohexylethyl methacrylate polymer in the same manner as in Example 5 to obtain a coated carrier.

Each of the carriers obtained in Examples 1 to 5 and Comparative Examples 1 to 3 was mixed with a toner which comprised 100 parts of a styrene-n-butyl methacrylate copolymer (80:20 by mol) and 10 parts of carbon black (Ligal 330, produced by Cabot Co.) and had a mean particle size of 11 μm, to prepare a developer having a toner concentration of 3%.

The resulting developer was loaded in a bench machine for evaluation, and copying was carried out at a photoreceptor speed of 350 mm/sec and a developing magnetic roll (sleeve) speed of 550 mm/sec. The quantity of charge, solid image density, fog density at background areas, fine line reproducibility, and adhesion of the carrier to the photoreceptor were evaluated both in the initial stage of copying and after running 100,000 times. Further, the same test running was carried out under a high humidity condition (30° C., 80% RH) or a low humidity condition (10° C., 30% RH) to observe any change in performance. The results obtained are shown in Table below.

TABLE

| | Charge Quantity | | Solid Density | | Fog Density at Background Area | | Fine Line Reproducibility | |
|---|---|---|---|---|---|---|---|---|
| Example No. | Initial Stage (μc/g) | After 100,000 Times Running (μc/g) | Initial Stage | After 100,000 Times Running | Initial Stage | After 100,000 Times Running | Initial Stage | After 100,000 Times Running |
| 1 | 14 | 12 | 1.45 | 1.30 | 0.00 | 0.02 | good | good |
| 2 | 13 | 9 | 1.45 | 1.30 | 0.00 | 0.03 | " | " |
| 3 | 15 | 14 | 1.35 | 1.40 | 0.00 | 0.00 | " | " |
| 4 | 12 | 9 | 1.50 | 1.40 | 0.00 | 0.02 | " | " |
| 5 | 15 | 14 | 1.35 | 1.40 | 0.00 | 0.00 | " | " |

TABLE-continued

| | | | | | | | | |
|---|---|---|---|---|---|---|---|---|
| Comparative Example | | | | | | | | |
| 1 | 12 | 5 | 1.50 | 1.25 | 0.00 | 0.09 | " | slightly poor |
| 2 | 15 | 7 | 1.40 | 1.45 | 0.00 | 0.06 | " | slightly poor |
| 3 | 15 | 7 | 1.38 | 1.30 | 0.00 | 0.06 | " | slightly poor |

| | Working Life | Change with Environment 30° C., 80% RH | Change with Environment 10° C., 30% RH | General Judgment |
|---|---|---|---|---|
| Example No. | | | | |
| 1 | more than 100,000 copies | none | none | good |
| 2 | more than 100,000 copies | " | " | " |
| 3 | more than 100,000 copies | " | " | " |
| 4 | more than 100,000 copies | " | " | " |
| 5 | more than 100,000 copies | " | " | excellent |
| Comparative Example | | | | |
| 1 | about 50,000 copies | fog at background areas due to reduction in charge quantitiy | density reduction due to increase in charge quantity | bad |
| 2 | about 60,000 copies | none | none | " |
| 3 | about 60,000 copies | none | none | " |

The results shown in the Table clearly demonstrate the superiority of the carrier according to the present invention.

While the invention has been described in detail and with reference to specific embodiments thereof, it will be apparent to one skilled in the art that various changes and modifications can be made therein without departing from the spirit and scope thereof.

What is claimed is:

1. A carrier for a developer for use in developing an electrostatic or magnetic latent image, comprising particles obtained by atomizing a molten mixture comprising:

a magnetic powder and a binder resin containing a first polyolefin and a second polyolefin having a functional group, wherein said polyolefin having a functional group is present in an amount of about 50% by weight or less based on the total weight of the binder resin.

2. A carrier as claimed in claim 1, wherein said functional group is selected from the group consisting of a hydroxyl, a carboxyl, an ester, a carbonyl, an ether, an amino, an amido, an imido, a nitrile, chlorine, fluorine, a perfluoroalkyl, a phenyl, a naphthyl, and a silicon-containing group.

3. A carrier as claimed in claim 1, wherein said functional group is selected from the group consisting of a carboxyl, a hydroxyl, an amino, a phenyl, and fluorine.

4. A carrier as claimed in claim 1, wherein said polyolefin having a functional group is a polymer obtained by polymerizing at least one fluorine-containing monomer in the presence of polyolefin.

5. A carrier as claimed in claim 1, wherein said polyolefin having a functional group is present in an amount ranging from about 0.01 to 50% by weight based on the total weight of the binder resin.

6. A carrier as claimed in claim 2, wherein said polyolefin having a functional group is present in an amount ranging from 0.2 to about 30% by weight based on the total weight of the binder resin.

7. A carrier as claimed in claim 4, wherein said polyolefin having a functional group is present in an amount ranging from 0.01 to 20% by weight based on the total weight of the binder resin.

8. A carrier as claimed in claim 4, wherein said polyolefin having a functional group is present in an amount ranging from 0.2 to 10% by weight based on the total weight of the binder resin.

9. A carrier as claimed in claim 1, wherein said particles have a spherical form and a mean particle size ranging from about 20 to 400 μm.

10. A carrier as claimed in claim 1, wherein said particles have a spherical form and a mean particle size ranging from about 30 to 200 μm.

11. A carrier as claimed in claim 1, wherein said carrier has a coat layer.

12. A carrier as claimed in claim 11, wherein said coat layer has a thickness ranging from 0.01 to 5 μm.

13. A carrier as claimed in claim 11, wherein said coat layer has a thickness ranging from 0.1 to 1.0 μm.

14. A carrier as claimed in claim 1, wherein said first polyolefin is selected from the group consisting of polymers of olefin monomers and conjugated diene type aliphatic diolefin monomers.

* * * * *